US005806893A

United States Patent [19]

Wilson et al.

[11] Patent Number: 5,806,893

[45] **Date of Patent: *Sep. 15, 1998**

[54] BINDER STIFFENER

[76] Inventors: Ronald A. Wilson, 14702 Danborough Rd., Tustin, Calif. 92680; Robert V. Tucker, 825 N. Red Robin St., Orange, Calif. 92669

[ * ] Notice: The term of this patent shall not extend beyond the expiration date of Pat. No. 5,669,635.

[21] Appl. No.: 889,700

[22] Filed: Jul. 8, 1997

Related U.S. Application Data

[63] Continuation of Ser. No. 764,094, Dec. 6, 1996, Pat. No. 5,669,635.

[51] Int. Cl.[6] ..... B12D 9/00

[52] U.S. Cl. ..... 281/30; 281/15.1; 402/4

[58] Field of Search ..... 281/30, 31, 15.1, 281/51, 42, 34, 45; 402/4; 206/214; 374/162, 142; D19/4

[56] References Cited

U.S. PATENT DOCUMENTS

| | | | |
|---|---|---|---|
| 218,764 | 8/1879 | Mosher | 206/214 |
| 325,992 | 9/1885 | Thain | 33/485 |
| 476,482 | 6/1892 | Oliver | 33/485 |
| 540,272 | 5/1895 | Rogers | 374/142 |
| 637,889 | 11/1899 | Parker | 281/30 |
| 1,346,393 | 7/1920 | Woodhouse | 281/30 |
| 1,539,164 | 5/1925 | Curtis | 281/15.1 |
| 2,005,474 | 6/1935 | Schade . | |
| 2,202,267 | 5/1940 | Posneck | 281/51 |
| 2,397,685 | 4/1946 | Neimann . | |
| 3,366,359 | 1/1968 | Wolf et al. . | |
| 3,513,806 | 5/1970 | Ferrick . | |
| 3,540,832 | 11/1970 | Morris | 402/80 R |
| 4,563,796 | 1/1986 | Kettlestrings . | |
| 5,037,136 | 8/1991 | McIntire . | |
| 5,108,130 | 4/1992 | Hansen . | |
| 5,509,634 | 4/1996 | Gebka et al. . | |
| 5,669,635 | 9/1997 | Wilson et al. | 281/30 |

*Primary Examiner*—Willmon Fridie, Jr.
*Attorney, Agent, or Firm*—Kelly Bauersfeld Lowry & Kelley, LLP

[57] ABSTRACT

A loose-leaf binder stiffener, which has a body (20) with an integral U-shaped channel portion (28) that grips the upper edge of a binder for holding it in an open and flat position. The channel portion includes an upper leg (32) with a wedge shaped end (36) that is forced between the binders spine (22) and ring holding rigid strip (38). A C-shaped portion (56) of the body (20) holds and stores pens or pencils and a raised upright member (60) adds stiffness. Three embodiments of the upright member (60) include a card holder (62), a beam (68), and a second C-shaped member (56').

20 Claims, 2 Drawing Sheets

BINDER STIFFENER

RELATED APPLICATION

This is a continuation of U.S. patent application Ser. No. 08/764,094, filed Dec. 6, 1996, now U.S. Pat. No. 5,669,635.

TECHNICAL FIELD

The present invention relates to loose-leaf type ring binder stiffeners in general. More specifically, to a stiffener adapted to be inserted along the top of a ring binder, holding it in an open position, included in the art of lap top notebooks.

BACKGROUND ART

Previously, many types of stiffeners have been used in endeavoring to provide an effective means for producing a holder to retain rigidity of books or binders in the open position.

Prior art is replete with structure utilizing rigid members for stiffness in one manner or another. In the past it has been found that structure of a rigid nature has been placed over the open face of a book or binder, either pivoted or clipped, to the center of the spine to accomplish this utility. Others have utilized a rigid structure to hold an open book or binder, but have not addressed the stiffness of the binder by itself.

Still, others have developed retainers for holding flat sheets of material between gripping arms. These inventions do not possess the stiffness, nor configuration, necessary to retain a multi-ring binder or loose-leaf binder securely in the open position.

A search of the prior art did not disclose any patents that read directly on the claims of the instant invention, however, the following U.S. patents are considered related:

| U.S. Pat. No. | Inventor | Issue Date |
|---|---|---|
| 5,509,634 | Gebka et al | Apr. 23, 1996 |
| 5,108,130 | Hansen | Apr. 28, 1992 |
| 5,037,136 | McIntire | Aug. 6, 1991 |
| 4,563,796 | Kettlestrings | Jan. 14, 1986 |
| 3,513,806 | Ferrick | May 26, 1970 |
| 3,366,359 | Wolf et al | Jan. 30, 1968 |
| 2,397,685 | Niemann | Apr. 2, 1946 |
| 2,005,474 | Schade | Jun. 18, 1935 |

U.S. Pat. No. 5,509,634, issued to Gebka et al, teaches an extruded holder to slip over the edge of shelves, held in place by a pair of resilient rearwardly extending arms forming a channel shape. A step near the web of the channel permits use on both thinner and thicker glass shelves.

Hansen, in U.S. Pat. No. 5,108,130, discloses a brace for a soft covered book, allowing it to stand in an upright position. Overlapping flaps, attached to the covers, overlie each other when the book is closed.

U.S. Pat. No. 5,037,136 of McIntire accomplishes the utility of preventing a binder or notebook from opening beyond a flat position by adding a rotatable strip of material along the outside surface of the spine. The rotatable strip is attached to the book with pressure sensitive self-adhering adhesive and pivots on a rivet in the middle. In use the strip is rotated from a position parallel with the spine to across the hinge seams, preventing them from opening beyond an approximate common plane.

U.S. Pat. No. 4,563,796, issued to Kettlestrings, is for a retainer for sheets of material in a fixed relationship formed of a substance having a memory. Two opposed legs grip together for attachment to flat sheets of material, such as paper stock.

Ferrick's U.S. Pat. No. 3,513,806 is directed to a book page holder having a length of wire formed into a clip attached to a rod. The rod provides a pair of coextensive arms separating the pages of a book. For storage, the rod is removed and inserted into a support portion of the holder.

U.S. Pat. No. 3,366,359 of Wolf et al is for an upwardly extending back rest-forming book stand. When retracted, it folds along the cover of a notebook.

Niemann teaches a device for distribution of account ledgers in U.S. Pat. No. 2,397,685. A spring-like clamp holds sheets over a number of pins and a T-square is used as a line guide.

For background purposes and as indicative of the art to which the invention relates, reference may be made to the patent issued to Schade.

DISCLOSURE OF THE INVENTION

Binders, such as the ringed type for holding individual sheets of paper, sometimes called loose-leaf notebooks, have been in common use for many decades and are extremely popular for students and organizations where written or printed material must be changed or updated from time to time. This almost universal type of binder is convenient for holding conventional written material and functions well as a hard surface to write on when placed on a flat table or desk. When the binder is placed on ones lap, however, it tends to be awkward and have a tendency to slip off, as it is hinged in the middle and one leaf is not large enough by itself to be stabilized on just one leaf. Further, the binder may be used to hold information when a person is standing, such as giving a talk, or just holding it open for reference, again creating a problem of stability as, if only one leaf is held, the other dangles down, or if they are held jointly in the middle, care must be taken to maintain an even grip on each side.

The present device fills a long felt need to convert a hinged loose-leaf binder into a rigid platform for writing on ones lap or holding open when standing, therefore, it may be considered as the primary object of the invention. This utility is achieved by inserting a simple one-piece binder stiffener over the top edge of the notebook simultaneously gripping both leaves and spine, also penetrating beneath the binders metallic ring holding rigid strip. This stiffener is sufficiently nonpliant and unbending, as to hold the binder flat, thus creating the desired rigid stand. It will be noted that this invention functions best with loose-leaf binders that have relatively hard and stiff covers. If the covers were soft and pliable, they could not be used as a writing surface anyway, and holding this type of binder flat would not prevent the covers from drooping under their own weight.

An important object of the invention is that the stiffener is sufficiently resilient to grip most binders, particularly the 3-ring type, having vinyl encapsulated cardboard covers. The stiffener is configured with a relatively thin section on the lower leg that compresses against a wedge shaped upper leg. This configuration permits the binder to have sufficient resiliency and memory to spring over the covers and, yet, maintain constant pressure between the upper and lower legs of this channel shaped cross-section for gripping purposes.

Another object of the invention permits writing utensils, such as pens and pencils, to be easily stored with a C-shaped section of the stiffener. This added utility is particularly useful, as the writing utensil is always available and is held securely by snap action of the section itself. A pen or pencil may be slid to one end for access and then simply be pulled outwardly for release by separating the fingers of the section. In one embodiment, an additional pair of C-shaped sections are utilized to offer double the writing utensil storage capabilities.

Yet another object of the invention consists of a pair of upstanding arms spaced apart sufficiently to hold and retain a card or notepaper in a vertical position. The preferred embodiment incorporates this feature that serves not only as a stiffening, upright member, but includes its card holding capabilities, which add to the utility of the invention.

A final object of the invention is the capability of using convenient surfaces for diverse purposes. As an example, the invention includes a wedge shaped upper leg that is configured to slip between the binders web and metallic ring holding rigid strip. This upper leg wedge shape may easily be used as a straight edge and, by the addition of numbered graduations, it becomes a ruler for measuring distance.

Further, the invention contains an integral recessed flat surface on the upper leg between the wedge shaped end and web, which becomes an ideal facade for applying decals, silk screen, printed media, decorative appliques, advertising messages, and the like. This surface may also have specific use devices attached, such as a calendar or liquid crystal temperature indicator (thermometer), etc., thus increasing its overall utility.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
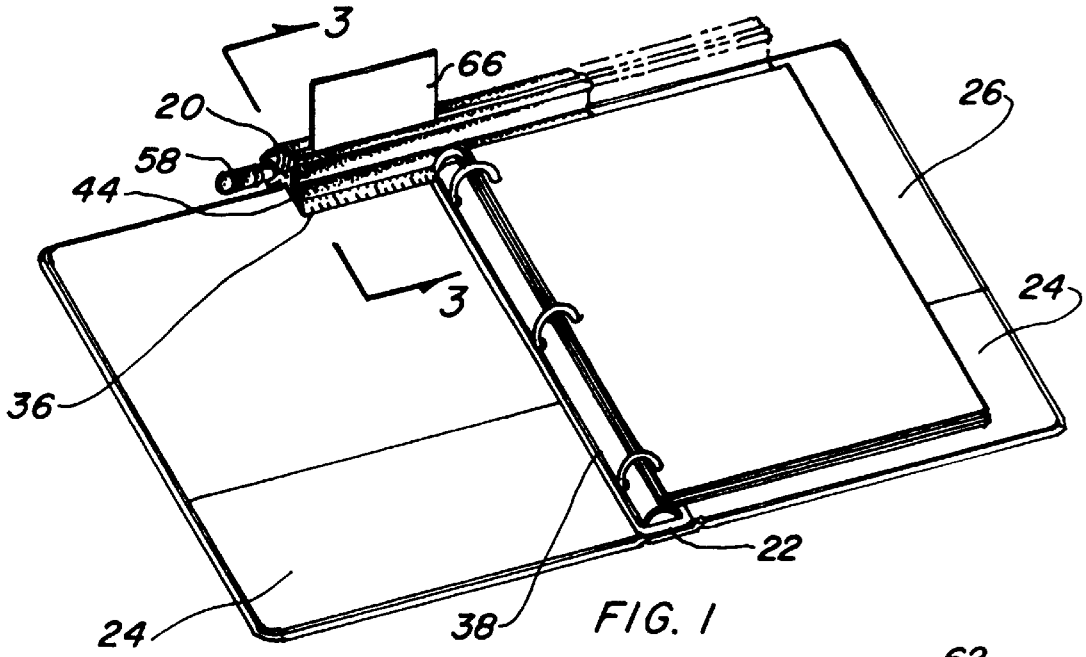
FIG. 1 is a partial isometric view of the preferred embodiment illustrating a loose-leaf binder with the invention in place, having a card and pencil attached. Phantom lines indicate storage location along the cover when not in use.

The best mode for carrying out the invention is presented in terms of a preferred, second and a third embodiment.

All three embodiments are primarily designed alike, except an integral raised nonpliant upright member is configured as a beam in the second embodiment and a second C-shaped member in the third embodiment. The preferred embodiment, as shown in FIGS. 1 through 6, is comprised of a stiffener body 20 that has a longitudinal length that is sufficient to interface with a multi-ring loose-leaf binder spine 22 and a portion of each cover 24. The actual length would vary as to the type of notebook binder 26, such as a 3-ring binder for 8-½×11-inch (21.6 cm×28 cm) paper would preferably be 8-inches (20.3 cm) long. The most appropriate binder 26 for use with this invention is the type having a cardboard spine 22 and matching cardboard covers 24 enclosed in vinyl, or some other synthetic material, as they are stiff enough to be held by hand or on ones lap when the invention is installed in place.

Figure 2:
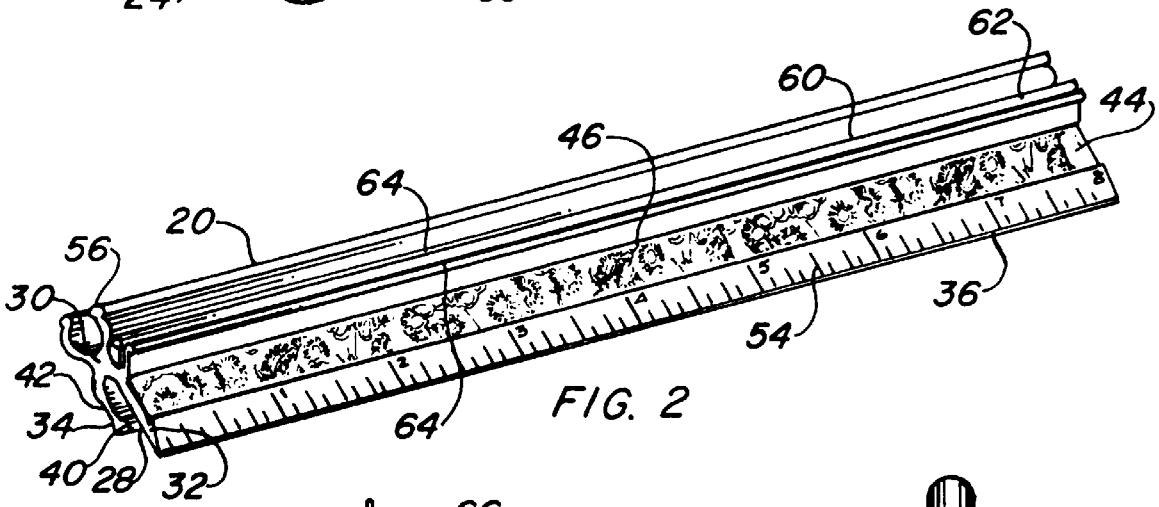
FIG. 2 is a partial isometric view of the preferred embodiment shown by itself complete with a decorative applique and ruler graduations.
Figure 3:
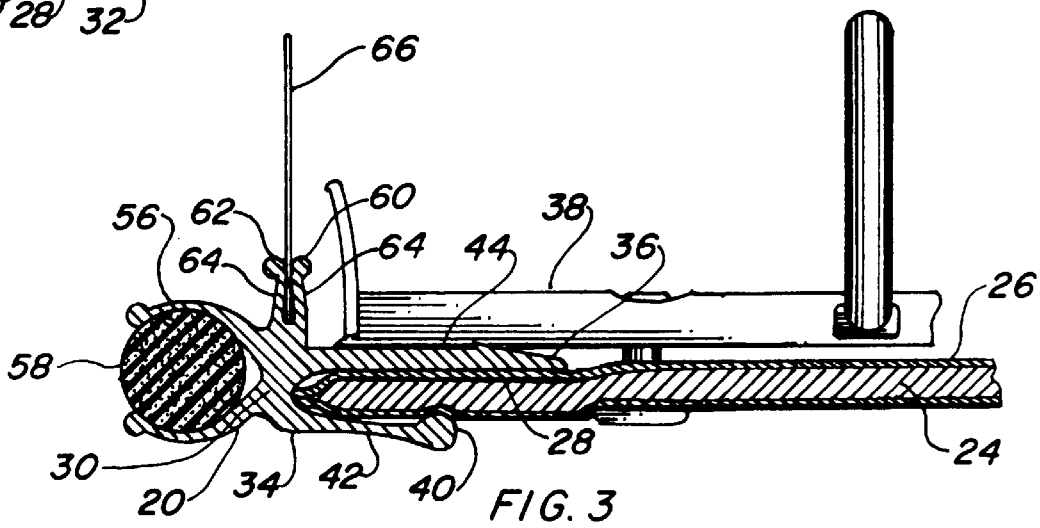
FIG. 3 is a cross-sectional view taken along lines 3—3 of FIG. 1.

The body 20, shown in FIGS. 1 through 3, is preferably made of a thermoplastic extruded material, such as polycarbonate, polyphenylene sulfide, polyethylene, polypropylene, polyvinyl chloride, and the like. The polymer may be colored or transparent, and is extruded in long strips and cut to the desired length after forming. While extrusion tooling is considerably more economical, injection molding may also be used in forming the invention, which easily includes other integral features that must be added later, as a separate procedure when using the simpler tooling. Thermoplastics, as described above, may also be used as the material for injection molding or thermoset plastic, such as polyester, etc. Another material may also be used with the invention with equal ease and dispatch, which is aluminum, extruded in like-manner as above. The aluminum material could be dead soft or tempered to add resiliency, as required, and the shape may be slightly altered in areas used for gripping the binder 26 tightly. FIGS. 1 through 3 depict the invention in any of the above described plastic materials.

The body 20 is shaped with an integral, springable U-shaped channel portion 28 that includes a web 30, an upper leg 32 and a lower leg 34. This channel shape permits the stiffener to be mounted on the upper edge of a binder 26, with the channel portion 28 sprung apart when installed with the resilient nature of the material having spring-like characteristics gripping the binder 26 sufficiently to hold the stiffener in place. FIG. 3 illustrates the stiffener installed in place over a conventional binder.

The upper leg 32 of the channel portion 28 is longer than the lower leg 34 and has a wedge shaped end 36 that is fashioned to penetrate between a binders spine 22 and a ring holding rigid strip 38, common to loose-leaf binders. FIGS. 2 and 3 illustrate this channel portion 28 separately and also gripping the binder 26. The length of the upper leg 32 is sufficiently long to penetrate almost the entire space between the binder spine 22 and the rigid strip 38 and, yet, short enough to permit the web 30 of the channel portion 28 to touch the binder 26.

The lower leg 34 also contains a raised bead 40 on the end opposite the web 30. This bead 40 faces the upper leg 32 and assists in gripping the binder cover 24 and spine 22 when the stiffener is installed. While the bead 40 is depicted in the drawings as being smooth, a series of ridges or serrations may be included to better the grip against the binder 26, if so desired.

The lower leg 34 of the channel portion 28 further includes a thinned section 42 between the raised bead 40 and the web 30 permitting the leg to bend at an optimum location controlling the spring force resistance and placing it at the best possible position. This thinned section 42 assists holding the stiffener tightly in place between the bead, 40 and upper leg 32 when manually inserted over the hinged covers 24 and spine 22 of a binder 26.

The upper leg 32 includes an integral recessed flat surface 44 between the web 30 and wedge shaped end 36. This flat surface 44 is depicted in FIGS. 2 through 8, and is recessed only slightly about the thickness of a vinyl decal, or the like, from 0.005 to 0.020 inches (0.25 mm to 0.50 mm) is preferred.

A decorative applique 46 of printed, silk screened material, or other substances, either plain or covered with a clear coating or film, may be used to add decoration to the stiffener, such as illustrated in FIG. 2.

Figure 4:
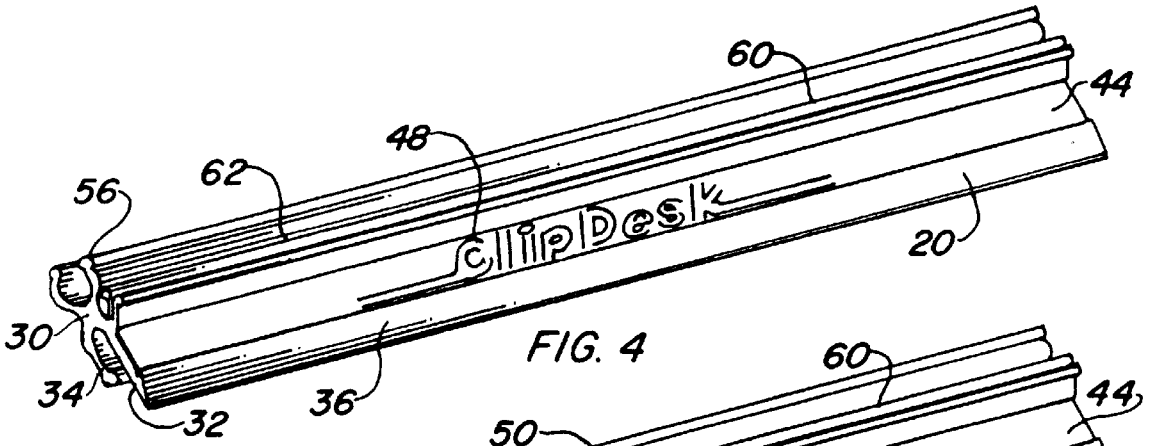
FIG. 4 is a partial isometric view of the preferred embodiment with an advertising logo in the recessed flat surface.

An advertising message 48 in any media, as previously described, may be added to this flat surface 44, as depicted in FIG. 4. Embossing, roll marking, etc., may be utilized for the metallic construction and imprinting, either raised or recessed, may be employed in the injection molding process.

Figure 5:
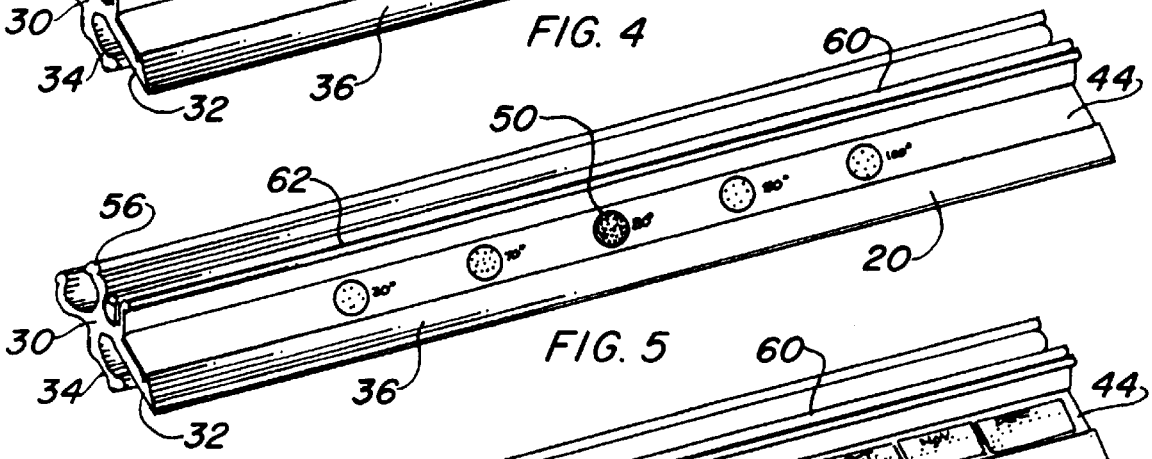
FIG. 5 is a partial isometric view of the preferred embodiment with a temperature indicator in the recessed flat surface.

A temperature indicator 50 in the form of a temperature indicating label or a liquid crystal reversible temperature indicator may be attached to this flat surface 44, as depicted in FIG. 5. The inclusion of this type of device in the stiffener simply expands the utility and provides useful information to the user.

Figure 6:
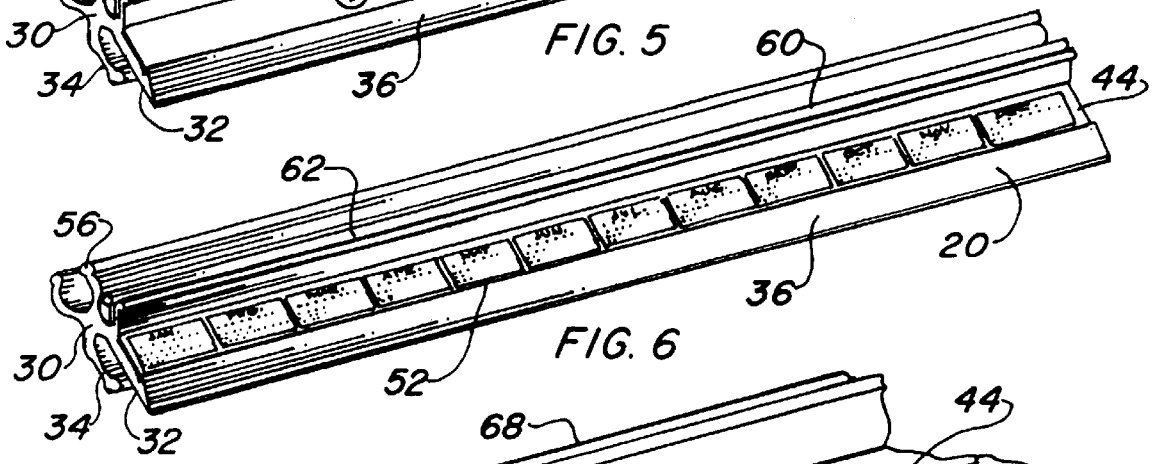
FIG. 6 is a partial isometric view of the preferred embodiment with a calendar in the recessed flat surface.

Optionally, a calendar 52 may be incorporated into this same flat surface, as illustrated in FIG. 6, using the same methods as described above, including the variations. It will be noted that only a few elements have been described thusfar, as this flat surface 44 may be the platform for any other useful indicia and devices, which fall well within the scope of this invention.

The upper leg wedge shaped end 36 may be plain, or include graduations 54, forming a ruler for measuring distance. The graduations 54 may be integral with the leg 32, such as imprinted, roll marked, stamped, etc., or may be added by printing on material and attaching by pressure sensitive adhesive. At any rate, the stiffener may be easily removed from its storage along one edge of the cover 24 and utilized as a ruler, or even a straight edge, when writing or drawing on paper contained within the notebook binder 26.

While the description of the stiffener body 20 has been directed toward the channel portion 28 so far, a continuation of the overall shape includes a C-shaped portion 56 immediately opposite the channel web 30. This C-shaped portion 56 is sized to springably receive writing utensils, such as pens or pencils. FIG. 1 and FIG. 3 illustrate a pencil 58 that has been snapped into place within the gripping shape portion. While a pencil 58 is illustrated, the C-shaped portion is sized to fit most conventional sized pens and mechanical pencils, also, unless they are irregularly shaped or oversized. The utility of this shape is obvious, as it permits easy storage and accessibility to writing implements used in conjunction with the paper stored in the loose-leaf binder.

The final shape included within the stiffener body 20 is an integral raised nonpliant upright member 60. This upright member 60 adjoins the channel web 30 and C-shaped portion 56 in an upstanding position relative to the body when installed on a horizontally disposed binder. This upright member 60 provides linear stability, rigidity and structural integrity to the stiffener.

The preferred embodiment of this upright member 60 is illustrated in FIGS. 1 through 6 and includes a card holder 62 having the form of a pair of upstanding arms 64 spaced sufficiently apart as to hold and retain a card 66 therebetween. This preferred embodiment adds further utility to this member, as it not only acts as reinforcement for its rigidity, but holds business cards, 3×5 cards, notes on plain or folded paper, and the like, in a vertical position visible to the user when the stiffener is in place.

Figure 7:
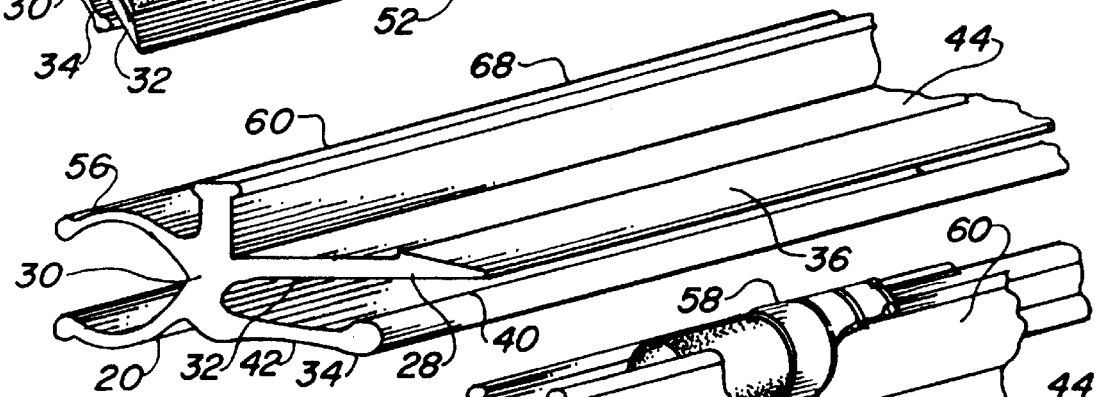
FIG. 7 is a fragmentary isometric view of the second embodiment with the beam upright member.

The second embodiment of this upright member 60 is depicted in FIG. 7 and incorporates a beam 68 having a raised flat elongated radial edged top surface. This beam offers the strongest configuration for its size and an extremely high section modulus of elasticity.

Figure 8:
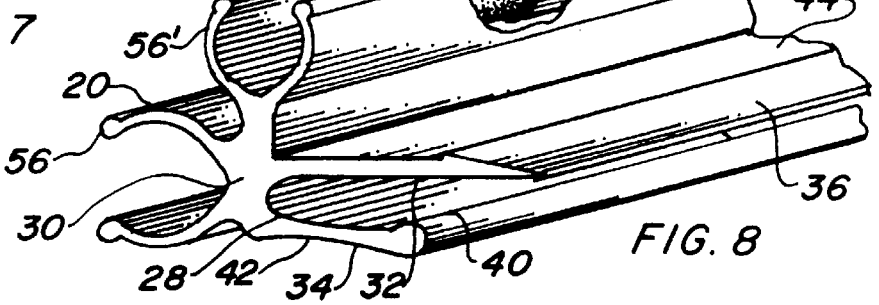
FIG. 8 is a fragmentary isometric view of the third embodiment with a pencil partially shown in the second C-shaped member.

The third and final embodiment of the upright member 60 is shown in FIG. 8 and incorporates a second C-shaped member 56' identical to the portion 56 integral with the body 20 and previously described. This second C-shaped member 56' is sized and functions in the same manner as portion 56 in that it receives and stores writing utensils. The addition of this embodiment of the upright member 60 simply increases the storage capacity of the device while also adding the reinforcement necessary for overall stiffness requirements.

In operation the stiffener is placed over the top edge of a loose-leaf binder 26 gripping both covers 24 simultaneously, along with the spine 22 in the middle. The wedge shaped end 36 of the U-shaped channel portion 28 is forced under the binders metallic rigid strip 38 and the upper 32 and lower legs 34 spring open and grip the binder to hold it in the open position. When not in use the stiffener is slid to one side gripping only one cover 24, as shown in phantom in FIG. 1, or removed and placed on any other edge of the cover.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

What is claimed is:

1. A spined multi-ring loose-leaf binder stiffener for holding hinged covers of a binder open in a flat, rigid position, comprising:

a stiffener body having a longitudinal length sufficient to interface with a binder spine and a portion of each cover, said body having a springable channel portion including a web, an upper leg and a lower leg, for resistably gripping an upper edge of the binder when forced thereupon, and said body further having a raised nonpliant upright member adjoining said channel web, for linear rigidity and structural integrity of the binder stiffener.

2. The binder stiffener as recited in claim 1, wherein the channel portion upper leg includes an end fashioned to penetrate between a binder's spine and a ring holding rigid strip when disposed upon an upper edge of a binder.

3. The binder stiffener as recited in claim 1, wherein said stiffener body further includes a portion opposite said channel web, sized to springably receive writing utensils, permitting storage and accessibility thereof.

4. The binder stiffener as recited in claim 1, wherein said body is formed of thermoplastic material.

5. The binder stiffener as recited in claim 1, wherein said body is formed of thermoset plastic material.

6. The binder stiffener as recited in claim 1, wherein said body is formed of extruded aluminum material.

7. The binder stiffener as recited in claim 1, wherein said channel portion upper leg further comprises an integral recessed flat surface between the web and the end.

8. The binder stiffener as recited in claim 7, wherein said upper leg recessed flat surface contains a decorative applique.

9. The binder stiffener as recited in claim 7, wherein said upper leg recessed flat surface contains an advertising message.

10. The binder stiffener as recited in claim 7, wherein said upper leg recessed flat surface contains a temperature indicator.

11. The binder stiffener as recited in claim 7, wherein said upper leg recessed flat surface contains a calendar.

12. The binder stiffener as recited in claim 1, wherein said nonpliant upright member further comprises a card holder shaped to include a pair of upstanding arms spaced sufficiently apart to hold and retain a card therebetween.

13. The binder stiffener as recited in claim 1, wherein said nonpliant upright member further comprises a beam having a raised flat elongated radial edged top surface.

14. The binder stiffener as recited in claim 1, wherein said nonpliant upright member further comprises a member sized to springably receive writing utensils permitting additional storage and accessibility.

15. A spine stiffener including a body having a longitudinal length sufficient to interface with a portion of the covers hinged to a spine and to hold them open in a flat, rigid position, the stiffener body comprising:

a springable channel portion including a web, an upper leg and a lower leg, for resistively gripping an upper edge of the covers when forced thereupon;

a raised nonpliant upright member adjoining said channel web, for linear rigidity and structural integrity of the spine stiffener; and a receiving portion generally opposite the channel portion relative to the upright member, sized to springably receive writing utensils, permitting storage and accessibility thereof.

16. The spine stiffener as recited as recited in claim 15, wherein said channel portion upper leg further comprises an integral recessed flat surface between the web and the end.

17. The spine stiffener as recited in claim 16, wherein said nonpliant upright member further comprises a card holder shaped to include a pair of upstanding arms spaced sufficiently apart to hold and retain a card therebetween.

18. The spine stiffener as recited in claim 16, wherein said nonpliant upright member further comprises a beam having a raised flat elongated radial edged top surface.

19. The spine stiffener as recited in claim 16, wherein said nonpliant upright member further comprises a member sized to springably receive writing utensils permitting additional storage and accessibility.

20. The spine stiffener as recited in claim 15, wherein the channel portion upper leg has an end that is fashioned to penetrate between the spine and a ring-holding rigid strip interiorly fixed to the spine, when disposed upon an upper edge of the covers.

* * * * *